455/5

United States Patent [19]
Watanabe
[11] 4,148,021
[45] Apr. 3, 1979

[54] ALARM SYSTEM UTILIZING BIDIRECTIONAL WIRED TELEVISION SYSTEM

[75] Inventor: Masakatsu Watanabe, Akatsukashin, Japan

[73] Assignee: Hochiki Corporation, Tokyo, Japan

[21] Appl. No.: 831,316

[22] Filed: Sep. 7, 1977

[30] Foreign Application Priority Data

Sep. 8, 1976 [JP] Japan ..... 51-107579

[51] Int. Cl.² ..... G08B 1/08

[52] U.S. Cl. ..... 340/531; 340/505; 325/55; 325/308

[58] Field of Search ..... 340/288, 310 R, 311, 340/416; 325/308; 179/DIG. 1, DIG. 23

[56] References Cited

U.S. PATENT DOCUMENTS

| | | | |
|---|---|---|---|
| 3,840,812 | 10/1974 | Takeuchi et al. | 325/308 |
| 3,996,578 | 12/1976 | Takeuchi et al. | 340/416 |
| 4,075,628 | 2/1978 | Masuda et al. | 340/416 |

*Primary Examiner*—Alvin H. Waring
*Attorney, Agent, or Firm*—Sughrue, Rothwell, Mion, Zinn and Macpeak

[57] ABSTRACT

An alarm system utilizes a bidirectional wired TV system constructed to transmit a TV signal received by a community antenna to a central station and a plurality of subscribers' stations through a bidirectionally transmissible line. Each of the subscribers' stations is provided with an automatic and/or manual alarm signal generator for generating a low frequency alarm signal representing any of emergency conditions and the subscriber's number, a carrier wave generator, and a modulator for modulating a high frequency carrier wave signal generated by the carrier wave generator with the alarm signal from the alarm signal generator. The central station is provided with a demodulator for receiving and demodulating the modulated alarm signal transmitted from any subscriber's station through the bidirectionally transmissible line, an alarm signal identifying device energized by the demodulated alarm signal from the demodulator, a carrier wave generator, and a remodulator for remodulating a different high frequency carrier wave signal generated by the carrier wave generator with the demodulated alarm signal from the demodulator. Any of the subscribers' stations are each further provided with a redemodulator for receiving and redemodulating the remodulated alarm signal transmitted from the central station through the bidirectionally transmissible line, and an alarm signal identifying device energized by the redemodulated alarm signal from the redemodulator.

7 Claims, 1 Drawing Figure

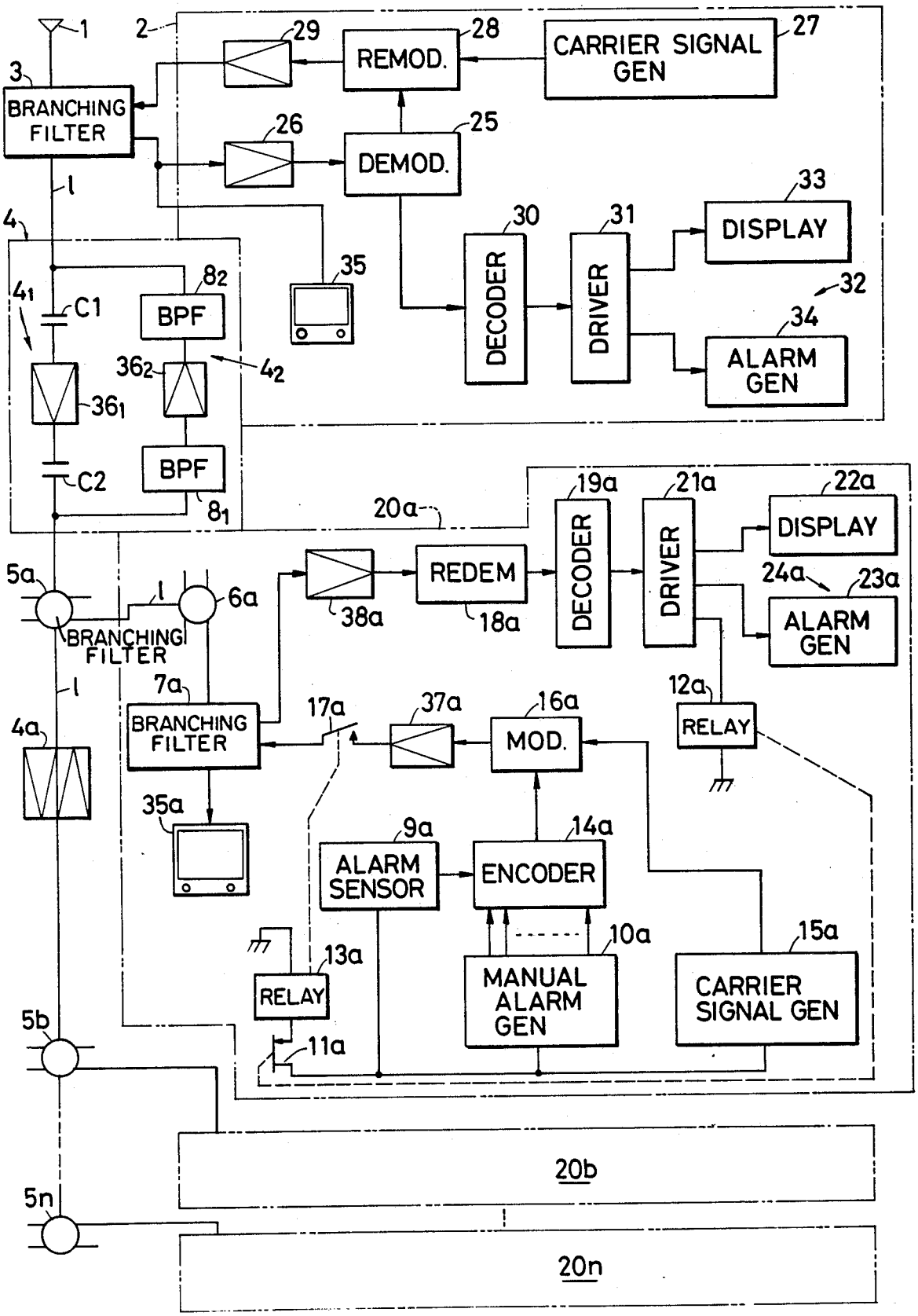
1
2
3
BRANCHING FILTER
29
REMOD.
28
CARRIER SIGNAL GEN
27
26
DEMOD.
25
33
DISPLAY
30
DECODER
31
DRIVER
32
34
ALARM GEN
35
4
41
C1
82
BPF
362
42
361
C2
BPF
81
19a
21a
22a
DISPLAY
20a
REDEM
DECODER
DRIVER
24a
23a
ALARM GEN
5a
6a
38a
18a
BRANCHING FILTER
7a
BRANCHING FILTER
17a
37a
16a
MOD.
12a
RELAY
4a
35a
9a
ALARM SENSOR
14a
ENCODER
10a
MANUAL ALARM GEN
15a
CARRIER SIGNAL GEN
13a
RELAY
11a
5b
20b
5n
20n

ALARM SYSTEM UTILIZING BIDIRECTIONAL WIRED TELEVISION SYSTEM

BACKGROUND OF THE INVENTION

The present invention relates to an alarm system capable of bidirectionally transmitting an alarm signal representative of any of emergency conditions such as a fire, a burglary and the like between a central station and a plurality of subscribers' stations through a bidirectionally transmissible line interconnecting the central station and the respective subscribers' stations, and more particularly to such an improved alarm system effectively utilizing the existing bidirectional wired TV system.

Prior art alarm systems constructed to present an emergency alarm service to any of the customers of a community antenna TV system (hereinafter referred to as "CATV" system) generally have the disadvantage that they are considerably complicated and expensive in construction.

For example, a prior art alarm system constructed to take up an image representative of an emergency condition such as a fire, a burglary or the like transmitted from any of the subscribers' stations by an ITV camera in a central station and then to transmit the take-up image to the respective subscribers in a forced interrupting operation requires a particular ITV camera in the central station and a forced power supply closing device and a forced channel interrupting device in the respective subscribers' stations. Consequently, such a prior art alarm system has the disadvantages that it is necessary to modify the respective subscribers' TV receivers and the supervisor must be available at the central station since the reception of an emergency alarm signal from any of the subscribers' stations and the response thereto must be carried out at the central station.

SUMMARY OF THE INVENTION

It is therefore an object of the invention to provide an improved alarm system utilizing a bidirectional wired TV system which is comparatively simple and inexpensive in construction and in which the supervisor need not necessarily be available at the central station.

The object of the invention is attained by providing in the central station a remodulator, in addition to a demodulator for demodulating a modulated low frequency alarm signal representative of any emergency condition transmitted from any of the subscribers' stations, for remodulating a high frequency carrier wave generated by a carrier wave generator with a demodulated alarm signal from the demodulator; and by providing in any of the subscriber stations a redemodulator, in addition to a modulator for initially modulating a different high frequency carrier wave generated by a carrier wave generator with the low frequency alarm signal for redemodulating a remodulated alarm signal transmitted from the central station.

BRIEF DESCRIPTION OF THE DRAWING

The single drawing FIGURE shows a schematic block diagram of an alarm system according to the invention utilizing a CATV system.

PREFERRED EMBODIMENT OF THE INVENTION

In the FIGURE, reference symbols 1 and l designate a community TV antenna and a bidirectional signal transmission line consisting, e.g., of a coaxial line, respectively. A TV signal received by the community antenna 1 is applied to a TV receiver 35 installed in a head or central station 2 such as a residential supervisor's office via a common or main bidirectional branching filter 3, and applied to individual subscribers' TV receivers 35*a* . . . (only one shown) via a first amplifier section $4_1$ included in a common bidirectional amplifier 4 and constituted by a series circuit consisting, e.g., of a capacitor Cl, an amplifier $36_1$ and a capacitor C2, and via individual subscribers' first and second bidirectional splitters or branching filters 5*a*, 5*b* . . . 5*n*, 6*a* . . . and via individual subscribers' bidirectional branching filters 7*a* . . . . The bidirectional branching filters 3 and 7*a* . . . may be each comprised of the appropriate combination of band, low and high pass filters and the splitters or branching filters 5*a* to 5*n* and 6*a* . . . may be each comprised of a plurality of parallel connected bidirectional wideband fillers or amplifiers. The bidirectional amplifier 4 comprises a parallel circuit consisting of the first amplifier section $4_1$ and a second amplifier section $4_2$. The second amplifier section $4_2$ comprises a series circuit consisting, e.g., of a bandpass filter $8_1$, an amplifier $36_2$ and a bandpass filter $8_2$. Also, bidirectional amplifiers 4*a* . . . each having a similar construction to the common bidirectional amplifier 4 are connected between the respective adjacent subscribers' bidirectional splitters or brancing filters 5*a*–5*b*, . . . .

Thus, respective subscribers' stations 20*a*, 20*b* . . . 20*n* such as residential subscribers' premises are each provided with an automatic emergency alarm sensor unit 9*a* including, e.g., a smoke sensor, a burglary sensor utilizing a doppler effect and the like, and with a manually operated emergency alarm signal generator 10*a* of a push-button type. The sensor unit 9*a* and the generator 10*a*, each functioning to deliver a low frequency alarm signal when any of emergency conditions such as a fire, a burglary and the like occurs, are commonly connected to ground via a normally closed relay contact 11*a* opened when a relay 12*a* described hereinafter is energized and via a relay 13*a*. The output terminals of the sensor unit 9*a* and the generator 10*a* are connected to the corresponding input terminals of an encoder 14*a*. The output terminal of the encoder 14*a* and the output terminal of a carrier wave generator 15*a* made operative when the alarm signal is delivered from either the sensor unit 9*a* or the generator 10*a* to generate a predetermined high frequency (e.g., 1MHz or 10MHz) carrier wave signal are connected to the corresponding input terminals of a modulator 16*a*. The output terminal of the modulator 16*a* is connected via an amplifier 37*a* and a normally open relay contact 17*a*, closed when the relay 13*a* is energized, to a predetermined terminal of the bidirectional branching filter 7*a*. The branching filter 7*a* has another terminal connected via an amplifier 38*a* to the input terminal of a redemodulator 18*a*. The output terminal of the redemodulator 18*a* is connected via a decoder 19*a* to the input terminal of a driver 21*a*. The driver 21*a* has a first output terminal connected to a display 22*a* such as a conventional 7-segment display, a second output terminal connected to an alarm generator 23*a* such as a buzzer or bell, and a third output terminal connected via the relay 12*a* to the ground. The display 22a and the alarm generator 23a jointly constitute an alarm signal recognizer or identifier 24a.

On the other hand, the central station 2 is provided with a demodulator 25 having an input terminal connected via an amplifier 26 to a predetermined terminal of the main bidirectional branching filter 3. The output terminal of the demodulator 25 and the output terminal of a carrier wave generator 27 for generating a predetermined high frequency (e.g., 148MHz, 73MHz or 246MHz) carrier wave signal are connected to the corresponding input terminals of a remodulator 28 having an output terminal connected via an amplifier 29 to another predetermined terminal of the main bidirectional branching filter 3. When a pilot signal generator for automatically controlling the gain of the bidirectional amplifiers 4, 4a, . . . is used, then the carrier wave generator 27 may comprise the pilot signal generator.

Thus, the output of the demodulator 25 is connected successively to a decoder 30, a driver 31, and an alarm signal identifier 32 including a display 33 and an alarm generator 34 respectively having substantially the same constructions as those provided in the subscribers' stations 20a to 20n.

The operation of the alarm system constructed as described above will now be described.

When any of emergency conditions such as a fire, a burglary and the like occurs at any one, e.g., 20a of the subscribers' stations 20a to 20n, then the relay 13a is energized to close its contact 17a and a low frequency alarm signal representative of the emergency condition and the number of the subscriber's station 20a is delivered from either the automatic alarm sensor unit 9a or the manually operated alarm generator 10a. The alarm signal thus delivered is converted by the encoder 14a into a predetermined coded alarm signal. As a result, the modulator 16a modulates a high frequency carrier wave signal generated by the carrier wave generator 15a with the coded alarm signal. The coded alarm signal thus modulated is transmitted from the subscriber's station 20a to the demodulator 25 provided in the central station 2 successively through the amplifier 37a, the now closed relay contact 17a, the bidirectional branching filter 7a, the second and first bidirectional splitters or branching filters 6a and 5a, the second amplifier section $4_2$ of the bidirectional amplifier 4, the main bidirectional branching filter 3 and the amplifier 26, and is demodulated by the demodulator 25. The coded alarm signal thus demodulated is decoded by the decoder 30 to display on the display 33 the emergency condition and the number of that of the subscribers' stations 20a to 20n which has generated the alarm signal, and to actuate, if necessary, the alarm generator 34 through the driver 31.

At the same time, the coded alarm signal demodulated by the demodulator 25 is applied to the remodulator 28 together with a high frequency carrier wave signal generated by the carrier wave generator 27.

As a result, the remodulator 28 remodulates the carrier wave signal from the generator 27 with the coded alarm signal from the demodulator 25. The coded alarm signal thus remodulated is transmitted from the central station 2 to the redemodulators 18a provided in the respective subscribers' stations 20a to 20n successively through the amplifier 29, the main bidirectional branching filter 3, the first amplifier section $4_1$ of the bidirectional amplifier 4, the first and second bidirectional splitters or branching filters 5a to 5n and 6a . . . ; the bidirectional branching filters 7a . . . and the amplifiers 38a, and is redemodulated by the redemodulator 18a. The coded alarm signal thus redemodulated is decoded by the decoder 19a to display on the display 22 the emergency condition and the number of that of the subscribers' stations 20a to 20n which has generated the alarm signal and to actuate, if necessary, the alarm generator 23a through the driver 21a. At the same time, the relay 12a is energized by the output of the driver 21a again to open its contact 17a, thereby positively preventing any signal from being transmitted from the subscribers' stations 20a to 20n to the central station 2.

As will be evident from the above description, the alarm system of the invention has the advantages that it has a comparatively simple and inexpensive construction, does not require that any person be present at the central station 2, and does not require the modification of the TV receivers installed in the subscribers' premises. Therefore, the central station 2 may be considered as one of the subscribers' stations.

It will be easily understood by those skilled in the art that the present invention is not limited by the embodiment described herein, but may be practiced by many variations and modifications within the technical concept of the invention.

What is claimed is:

1. An alarm system utilizing a bidirectional wired TV system which is constructed to transmit a TV signal received by a community antenna to a central station and a plurality of subscribers' stations through a bidirectionally transmissible line interconnecting said central station and said plural subscribers' stations, wherein:

said plurality of subscribers' stations are each provided with alarm signal generating means operative to generate a low frequency alarm signal representative of any emergency condition, a first carrier wave generator operative to generate a first carrier wave signal having a predetermined frequency higher than that of the alarm signal, and a modulator coupled with said alarm signal generating means and first carrier wave generator to modulate said first carrier wave signal with said alarm signal;

said central station is provided with a demodulator operative to receive and demodulate the modulated alarm signal transmitted from that of said plurality of subscribers' stations which is generating the alarm signal through said bidirectionally transmissible line, a first alarm signal identifying means coupled to said demodulator for identifying the emergency condition represented by the demodulated alarm signal from said demodulator, a second carrier wave generator operative to generate a second carrier wave signal having a predetermined high frequency different from that of said first carrier wave signal and a remodulator coupled to said demodulator and second carrier wave generator for remodulating the second carrier wave signal with the demodulated alarm signal from said demodulator; and at least one of said plurality of subscribers' stations is further provided with a redemodulator operative to receive and remodulate the remodulated alarm signal from said remodulator through said bidirectionally transmissible line, and a second alarm signal identifying means coupled with said redemodulator to identify the emergency condition represented by the redemodulated signal from said second demodulator.

2. The alarm system as defined in claim 1, wherein each of said plurality of subscribers' stations is further provided with an encoder coupled between said alarm signal generating means and said modulator to encode the alarm signal generated by the former into a coded signal and to modulate at the latter said first carrier wave signal with the coded signal delivered from said encoder; and wherein said first and second alarm signal identifying means each comprise a decoder coupled to the output of said corresponding demodulator and redemodulator, a driver coupled to the output of said decoder and visual display means coupled to the output of said driver.

3. The alarm system as defined in claim 2, wherein the coded signal encoded by said encoder includes a coded signal for identifying that of said plural subscribers' stations which has generated the alarm signal.

4. The alarm system as defined in claim 1, wherein said first and second alarm signal identifying means each comprise an alarm sound generator.

5. The alarm system as defined in claim 1, wherein said alarm signal generating means comprises automatic alarm sensing means for automatically sensing the alarm condition.

6. The alarm system as defined in claim 1, wherein said alarm generating means comprises a manually operated alarm generator.

7. The alarm system as defined in claim 1 further comprising at least one bidirectional amplifier disposed at the intermediate portion of said bidirectionally transmissible line, and wherein said second carrier wave generator comprises a pilot signal generator for automatically controlling the amplification factor of said bidirectional amplifier.

* * * * *